US008086452B2

(12) United States Patent
Yoshida

(10) Patent No.: US 8,086,452 B2
(45) Date of Patent: Dec. 27, 2011

(54) SCALABLE CODING APPARATUS AND SCALABLE CODING METHOD

(75) Inventor: Koji Yoshida, Kanagawa (JP)

(73) Assignee: Panasonic Corporation, Osaka (JP)

( * ) Notice: Subject to any disclaimer, the term of this patent is extended or adjusted under 35 U.S.C. 154(b) by 880 days.

(21) Appl. No.: 12/095,547

(22) PCT Filed: Nov. 29, 2006

(86) PCT No.: PCT/JP2006/323838

§ 371 (c)(1),
(2), (4) Date: May 30, 2008

(87) PCT Pub. No.: WO2007/063910

PCT Pub. Date: Jun. 7, 2007

(65) Prior Publication Data

US 2010/0153102 A1 Jun. 17, 2010

(30) Foreign Application Priority Data

Nov. 30, 2005 (JP) ..... 2005-346169

(51) Int. Cl.
*G10L 21/02* (2006.01)

(52) U.S. Cl. ..... 704/227; 704/501

(58) Field of Classification Search ..... 704/200.1, 704/222, 226, 227, 230, 500–504
See application file for complete search history.

(56) References Cited

U.S. PATENT DOCUMENTS

2002/0065648 A1 5/2002 Amano
2005/0147164 A1* 7/2005 Wu et al. ..... 375/240.12
2006/0122830 A1* 6/2006 Lee et al. ..... 704/229
2007/0253481 A1 11/2007 Oshikiri
2007/0271092 A1 11/2007 Ehara et al.
2008/0059166 A1 3/2008 Ehara
2008/0126082 A1 5/2008 Ehara et al.
2008/0162148 A1 7/2008 Goto et al.
2010/0182499 A1* 7/2010 Setton et al. ..... 348/409.1

FOREIGN PATENT DOCUMENTS

JP 10-97295 4/1989
JP 2002-162998 6/2002
JP 2003-202898 7/2003

(Continued)

OTHER PUBLICATIONS

Jung et al.; A bit-rate/bandwidth scalable speech coder based on ITU-T G.723.1 standard; ICASSP 2004, pp. 285-288, vol. 1.*

(Continued)

*Primary Examiner* — Abul K Azad
(74) *Attorney, Agent, or Firm* — Greenblum & Bernstein, P.L.C.

(57) ABSTRACT

A scalable coding apparatus is provided to suppress deterioration of a quality of a coded signal in a normal frame next to a frame compensated for the occurrence of a data loss. The scalable coding apparatus is provided with a core-layer coding section (11) to carry out core-layer coding for the n-th frame input audio signal, an ordinary coding section (121) to generate expanding-layer ordinary-coding layer L2(*n*) by carrying out ordinary-coding of an expanding layer for the input audio signal, a deterioration-compensation coding section (123) to generate an expanding-layer-deterioration coding data L2'(*n*) by carrying out compensation for quality deterioration of coded audio in a current frame due to a past frame loss, a judging section (125) to determine whether either the expanding-layer ordinary-coding data L2(*n*) or the expanding-layer deterioration-coding data L2'(*n*) should be output from the expanding-layer coding section (12) as expanding-layer coding data of the current frame.

7 Claims, 6 Drawing Sheets

FOREIGN PATENT DOCUMENTS

| | | |
|---|---|---|
| JP | 2003-249957 | 9/2003 |
| WO | 2005/109402 | 11/2005 |

OTHER PUBLICATIONS

ISO/IEC 14496-3: 2001 (E) Part-3 Audio (MPEG-4) Subpart-3 Speech Coding (CELP).

ISO/IEC 14496-3: 2001 (E) Part-3 Audio (MPEG-4) Subpart-1 Main Annex 1.B (Informative) Error Protection tool.

Johansson et al., "Bandwidth efficient amr operation for voip", Speech Coding, 2002, IEEE Workshop Proceedings, Oct. 6-9, 2002, Piscataway, NJ, USA, IEEE, Oct. 6, 2002, pp. 150-152, XP010647243.

* cited by examiner

| CONDITION | | | | SWITCH | DECODING OPERATION | |
|---|---|---|---|---|---|---|
| NUMBER | flag_FL(n−1) | flag_FL(n) | flag(n) | | CORE LAYER DECODING | ENHANCEMENT LAYER DECODING |
| 1 | 0 | 0 | 0 | a | GENERAL DECODING (USING L1(n)) | GENERAL DECODING (USING L2(n)) |
| 2 | | | 1 | a | | CONCEALMENT (NOT USING L2'(n)) |
| 3 | – | 1 | – | a | CONCEALMENT | CONCEALMENT |
| 4 | 1 | 0 | 0 | a | GENERAL DECODING (USING L1(n)) | GENERAL DECODING (USING L2(n)) |
| 5 | | | 1 | b | | DETERIORATION CONCEALMENT DECODING (USING L2'(n)) |

FIG.5

SCALABLE CODING APPARATUS AND SCALABLE CODING METHOD

TECHNICAL FIELD

The present invention relates to a scalable coding apparatus and scalable coding method.

BACKGROUND ART

In speech data communication over an IP network, speech coding with a scalable configuration is desired to realize traffic control over a network and multicast communication. The scalable configuration refers to a configuration of enabling the receiving side to decode speech data from a portion of coded data.

In scalable coding, coded data has a plurality of layers from lower layers including the core layer to higher layers including the enhancement layer resulting from layered coding of input speech signals on the transmitting side and is transmitted. The receiving side is able to carry out decoding using coded data of a lower layer to any higher layer (for example, see Non-Patent Document 1).

Further, to control frame loss over the IP network, by reducing the loss rate of coded data of lower layers compared to higher layers, it is possible to improve robustness to frame loss.

If loss of coded data of lower layers cannot be avoided even in this case, it is possible to conceal for loss using coded data received in the past (for example, see Non-Patent Document 2). That is, if, of layered coded data obtained by scalable coding of input speech signals in frame units, coded data of lower layers including the core layer is lost and cannot be received, the receiving side is able to carry out decoding by concealing for loss using coded data of past frames received in the past. Therefore, if frame loss occurs, it is possible to reduce quality deterioration of decoded signals to some extent.

Non-Patent Document 1: ISO/IEC 14496-3: 2001 (E) Part-3 Audio (MPEG-4) Subpart-3 Speech Coding (CELP)

Non-Patent Document 2: ISO/IEC 14496-3: 2001 (E) Part-3 Audio (MPEG-4) Subpart-1 Main Annex1.B (Informative) Error Protection tool

DISCLOSURE OF INVENTION

Problems to be Solved by the Invention

If coding is carried out depending on a state obtained by coding in the past, in a next normal frame after a frame in which loss is concealed for upon loss of coded data of lower layers including the core layer, state data becomes inconsistent between the transmitting side and the receiving side and decoded signal quality is likely to deteriorate. For example, when CELP coding is used as the coding scheme, there are adaptive codebook data, LPC synthesis filter state data, and prediction filter state data of LPC parameters or excitation gain parameters (in the case where prediction quantization is used as LPC parameters or excitation gain parameters) as state data used to encode next frames. Of these items of state data, with, particularly, the adaptive codebook storing past coded excitation signals, content generated in a frame in which loss is concealed for on the receiving side is significantly different from content on the transmitting side. In this case, even if the next frame after a frame in which loss is concealed for is a normal frame in which data loss does not occur, the receiving side decodes the normal frame using an adaptive codebook of different content from the transmitting side, and so quality of decoded signals is likely to deteriorate in the normal frame.

It is therefore an object of the present invention to provide a scalable coding apparatus and scalable coding method for enabling reduction in quality deterioration of decoded signals in a next normal frame after a frame in which data loss occurs and is concealed for.

Means for Solving the Problem

The scalable coding apparatus according to the present invention comprised of a lower layer and a higher layer, employs a configuration including: a lower layer coding section that encodes the lower layer and generates lower layer coded data; a loss concealing section that carries out predetermined loss concealment for frame loss of the lower layer coded data and generates state data; a first higher layer coding section that encodes the higher layer and generates first higher layer coded data; a second higher layer coding section that encodes the higher layer for correcting speech quality deterioration using the state data and generates second higher layer coded data; and a selecting section that selects one of the first higher layer coded data and the second higher layer coded data as transmission data.

Advantageous Effect of the Invention

The present invention is able to reduce quality deterioration of decoded signals in a next normal frame after a current frame in which loss is concealed for, even when data loss has occurred and has been concealed for in a past frame.

BRIEF DESCRIPTION OF DRAWINGS

FIG. 5 illustrates decoding processing of the scalable decoding apparatus according to Embodiment 1.

BEST MODE FOR CARRYING OUT THE INVENTION

Embodiments of the present invention will be described in detail below with reference to the accompanying drawings.

Embodiment 1

Figure 1:
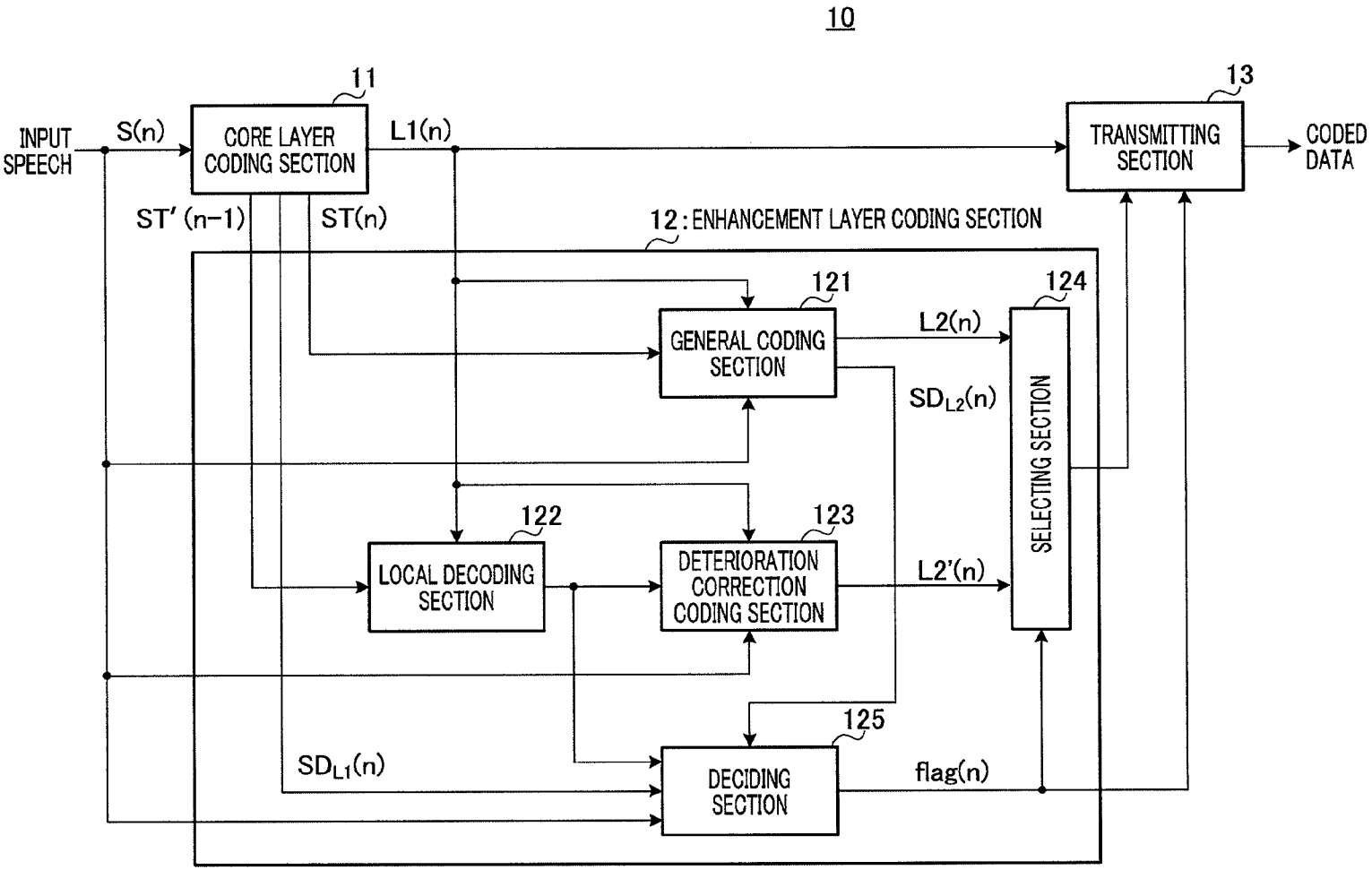
FIG. 1 is a block diagram showing a configuration of a scalable coding apparatus according to Embodiment 1.

FIG. 1 is a block diagram showing a configuration of scalable coding apparatus 10 according to Embodiment 1 of the present invention. Scalable coding apparatus 10 employs a configuration comprised of two layers of the core layer included in lower layers and the enhancement layer included in higher layers, and carries out scalable coding processing of inputted speech signals in speech frame units. A case will be described below as an example where speech signal S(n) of the n-th frame (where n is an integer) is inputted to scalable coding apparatus 10. Further, a case will be described as an example where the scalable configuration is comprised of two layers.

Further, an outline of the operation of scalable coding apparatus 10 will be described.

In scalable coding apparatus 10, first, core layer coding section 11 encodes the core layer of input speech signal S(n) of the n-th frame, and generates core layer coded data L1(nn) and state data ST(n).

Next, general coding section 121 of enhancement layer coding section 12 carries out general coding of the enhancement layer of input speech signal S(n) based on data (L1(nn) and ST(n)) obtained by encoding the core layer, and generates enhancement layer general coded data L2(n). General coding refers to coding which does not assume frame loss in the (n−1)-th frame. Further, general coding section 121 decodes enhancement layer general coded data L2(n) and generates enhancement layer decoded data $SD_{L2}(n)$.

Then, deterioration correction coding section 123 carries out coding for correcting quality deterioration of a decoded signal of the current frame due to frame loss in the past, and generates enhancement layer deterioration correction coded data L2'(n).

On the other hand, deciding section 125 decides which one of enhancement layer general coded data L2(n) and enhancement layer deterioration correction coded data L2'(n) should be outputted from enhancement layer coding section 12 as enhancement layer coded data of the current frame, and outputs the decision result flag, flag(n).

Selecting section 124 selects either enhancement layer general coded data L2(n) or enhancement layer deterioration correction coded data L2'(n) according to the decision result in deciding section 125, and outputs the result as enhancement layer coded data of the current frame.

Then, transmitting section 13 multiplexes core layer coded data L1(n), decision result flag, flag(n), and enhancement layer coded data (L2(n) or L2'(n)), and transmits the result to a scalable decoding apparatus as transmission coded data of the n-th frame.

Next, sections of scalable coding apparatus 10 will be described in detail.

Core layer coding section 11 carries out coding processing of a signal, which becomes the core component of an input speech signal, and generates core layer coded data. In case an input signal is a wideband speech signal with a 7 kHz bandwidth and band scalable coding is used, the signal which becomes the core component refers to a signal of the telephone band (3.4 KHz) width generated by carrying out band limitation of this wideband signal. On the scalable decoding apparatus side, even if decoding is carried out using only this core layer coded data, it is possible to guarantee quality of decoded signals to some extent.

Figure 2:
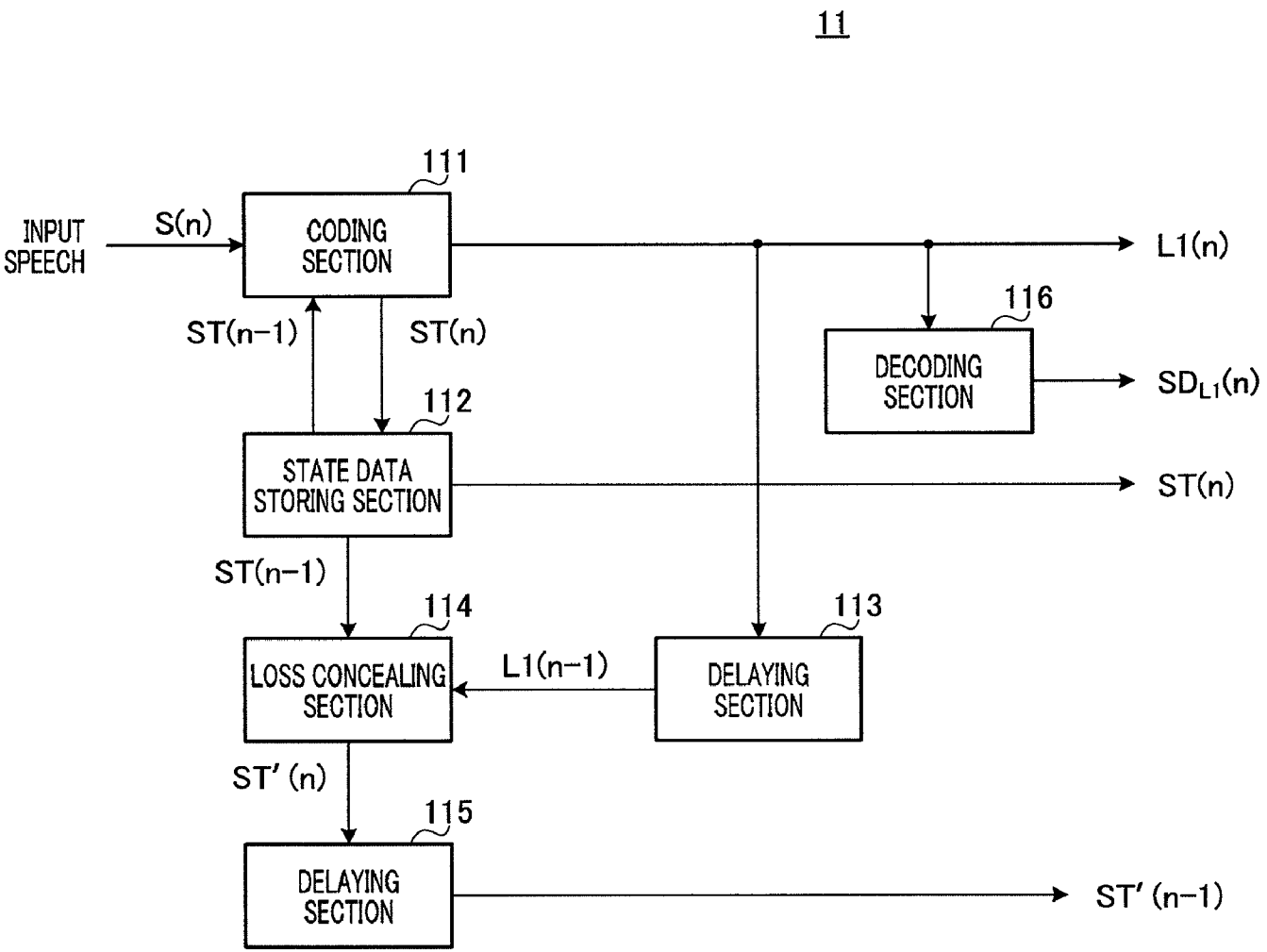
FIG. 2 is a block diagram showing a configuration of a core layer coding section according to Embodiment 1.

FIG. 2 shows a configuration of core layer coding section 11.

Coding section 111 encodes the core layer using input speech signal S(n) of the n-th frame and generates core layer coded data L1(n) of the n-th frame. The coding scheme used in coding section 111 may be any coding scheme as long as the coding scheme, for example, a CELP scheme, encodes the current frame depending on a state obtained by coding in the past frame. When band scalable coding is carried out, coding section 111 carries out down-sampling and LPF processing of input speech signals, and, after obtaining signals of the above predetermined band, encodes the signals. Further, coding section 111 encodes the core layer of the n-th frame using state data ST(n−1) stored instate data storing section 112 and stores state data ST(n) obtained as a result of coding, in state data storing section 112. State data stored in state data storing section 112 is updated every time new state data is obtained at coding section 111.

State data storing section 112 stores state data required for coding processing at coding section 111. For example, when CELP coding is used to carry out coding at coding section 111, state data storing section 112 stores, for example, adaptive codebook data and LPC synthesis filter state data as state data. Further, when prediction quantization is used as LPC parameters or excitation gain parameters, state data storing section 112 additionally stores prediction filter state data for LPC parameters or excitation gain parameters. State data storing section 112 outputs state data ST(n) of the n-th frame to general coding section 121 of enhancement layer coding section 12 and outputs state data ST(n−1) of the (n−1)-th frame to coding section 111 and loss concealing section 114.

Delaying section 113 receives an input of core layer coded data L1(n) of the n-th frame from coding section 111 and outputs core layer coded data L1(n−1) of the (n−1)-th frame. That is, L1(n−1) outputted from delaying section 113 is obtained by delaying by one frame core layer coded data L1(n−1) of the (n−1)-th frame inputted from coding section 111 in coding processing of a previous frame and is outputted in coding processing of the n-th frame.

Loss concealing section 114 carries out the same loss concealment processing as the loss concealment processing carried out for frame loss on the scalable decoding apparatus side when loss occurs in the n-th frame. Loss concealing section 114 carries out loss concealment processing for loss in the n-th frame using core layer coded data L1(n−1) and state data ST(n−1) of the (n−1)-th frame. Then, loss concealing section 114 updates state data ST(n−1) of the (n−1)-th frame to state data ST'(n) of the n-th frame according to the loss concealment processing and outputs updated state data ST'(n) to delaying section 115.

Delaying section 115 receives an input of state data ST'(n) of the n-th frame generated by loss concealment processing for loss in the n-th frame and outputs state data ST'(n−1) of the (n−1)-th frame generated by loss concealment processing for loss in the (n−1)-th frame. That is, ST'(n−1) outputted from delaying section 115 is obtained by delaying by one frame state data ST'(n−1) of the (n−1)-th frame inputted from loss concealing section 114 in coding processing of a previous frame and is outputted in coding processing of the n-th frame. This state data ST'(n−1) is inputted to local decoding section 122 and deciding section 125 shown in FIG. 1.

Decoding section 116 decodes core layer coded data L1(n) and generates core layer decoded data $SD_{L1}(n)$.

Sections of core layer coding section 11 have been described in details.

In enhancement layer coding section 12 shown in FIG. 1, local decoding section 122 decodes core layer coded data L1(n) of the n-th frame and generates core layer decoded data $SD_{L1}'(n)$. At this time, the (n−1)-th frame is assumed to be subjected to frame loss concealment, and so local decoding section 122 uses state data ST'(n−1) as state data upon decoding. Then, local decoding section 122 outputs decoded data $SD_{L1}'(n)$ and state data ST'(n−1).

Assume that, the (n−1)-th frame is subjected to frame loss concealment, deterioration correction coding section 123 carries out encoding for correcting speech quality deterioration of decoded data $SD_{L1}'(n)$. Deterioration correction coding section 123 employs the same coding as the general coding carried out in general coding section 121, encoding is performed in the enhancement layer with respect to decoded data $SD_{L1}'(n)$ using input speech signal S(n) and core layer coded data L1(n) based on state data ST'(n−1) assuming frame loss concealment for the (n−1)-th frame and generates enhancement layer deterioration correction coded data L2'(n).

Further, deterioration correction coding section 123 may encode an error signal between decoded data $SD_{L1}$'(n) and input speech signal S(n) and generate enhancement layer deterioration correction coded data L2'(n).

Deciding section 125 decides which one of enhancement layer general coded data L2(n) and enhancement layer deterioration correction coded data L2'(n) should be outputted from enhancement layer coding section 12 as enhancement layer coded data of the n-th frame, and outputs the decision result flag, flag(n), to selecting section 124 and transmitting section 13. (i) When the degree of speech quality deterioration of the core layer in the n-th frame caused by frame loss concealment in the (n−1)-th frame is greater than a predetermined value (that is, frame loss concealment capability of the core layer in the (n−1)-th frame (decoded speech quality upon concealment) is lower than the predetermined value), (ii) when the degree of speech quality improvement resulting from enhancement layer coding in the n-th frame is lower than the predetermined value or (iii) when frame loss concealment capability with respect to the enhancement layer in the n-th frame (decoded speech quality upon concealment) is greater than the predetermined value, deciding section 125 decides that enhancement layer coding section 12 outputs enhancement layer deterioration correction coded data L2'(n) as enhancement layer coded data of the n-th frame, and outputs the decision result flag, flag(n)=1. Otherwise, deciding section 125 decides that enhancement layer coding section 12 outputs enhancement layer general coded data L2(n) as enhancement layer coded data of the n-th frame, and outputs the decision result flag, flag(n)=0. Further, in cases equivalent both to the above (i) and (ii), deciding section 125 may decide that enhancement layer coding section 12 outputs enhancement layer deterioration correction coded data L2'(n).

To be more specific, deciding section 125 carries out decisions described below.

<Decision Method 1>

Deciding section 125 measures the SNR of decoded data $SD_{L1}$'(n) obtained at local decoding section 122 with respect to core layer decoded data $SD_{L1}$(n) as the degree of speech quality deterioration of the core layer in the n-th frame caused by frame loss concealment in the (n−1)-th frame, if the difference is equal to or more than a predetermined value, outputs the decision result flag, flag(n)=1, and, if the difference is less than a predetermined value, outputs the decision result flag, flag(n)=0.

<Decision Method 2>

Speech frames such as the speech onset portion and the unvoiced non-stationary consonant portion where a change from previous frames is significant and speech frames of non-stationary signals have low frame loss concealment capability using past frames, and so, with these speech frames, the degree of speech quality deterioration of decoded data $SD_{L1}$'(n) obtained at local decoding section 122 is significant. Then, deciding section 125 compares input speech signal S(n−1) with input speech signal S(n), outputs the decision result flag, flag(n)=1, if the power difference, pitch analysis parameter (pitch period and pitch prediction gain) difference and LPC spectrum difference between input speech signal S(n−1) and input speech signal S(n) are equal to or more than a predetermined value, and outputs the decision result flag, flag(n)=0, if these differences are less than a predetermined value.

Deciding section 125 measures to what extent the coding distortion in the case where coding is carried out up to the enhancement layer decreases with respect to the coding distortion in the case where coding is carried out only in the core layer, outputs the decision result flag, flag(n)=1, if this decrease is less than a predetermined value and outputs the decision result flag, flag(n)=0, if this decrease is equal to or more than a predetermined value. Similarly, deciding section 125 measures to what extent the SNR of decoded data $SD_{L2}$(n) in the case where coding is carried out up to the enhancement layer with respect to input speech signal S(n) increases with respect to the SNR of decoded data $SD_{L1}$(n) in the case where coding is carried out only in the core layer with respect to input speech signal S(n), outputs the decision result flag, flag(n)=1, if this increase is less than a predetermined value and outputs the decision result flag, flag(n)=0, if this increase is the predetermined value or greater.

<Detection Method 4>

When scalable coding employs a band scalable configuration, deciding section 125 calculates the balance of speech bands in input speech signals, that is, calculates the rate of signal energy in the low band as the core layer, with respect to signal energy in the full band, decides that the degree of speech quality improvement resulting from enhancement layer coding is low and outputs the decision flag, flag(n)=0, if this rate is equal to or more than a predetermined value, and outputs the decision result flag, flag(n)=1, if this rate is less than a predetermined value.

The decision methods in deciding section 125 have been described. By carrying out decision as described above and limiting cases where enhancement layer deterioration correction coded data is made enhancement layer coded data, it is possible to, when frame loss does not occur, reduce speech quality deterioration resulting from the fact that decoding cannot be carried out using enhancement layer general coded data and improve core layer frame loss robustness.

Selecting section 124 selects either enhancement layer general coded data L2(n) or enhancement layer deterioration correction coded data L2'(n) according to the decision result flag, flag(n), from deciding section 125 and outputs the result to transmitting section 13. Selecting section 124 selects enhancement layer general coded data L2(n) in case of the decision result flag, flag(n)=0, and selects enhancement layer deterioration correction coded data L2'(n) in case of the decision result flag(n)=1.

Figure 3:
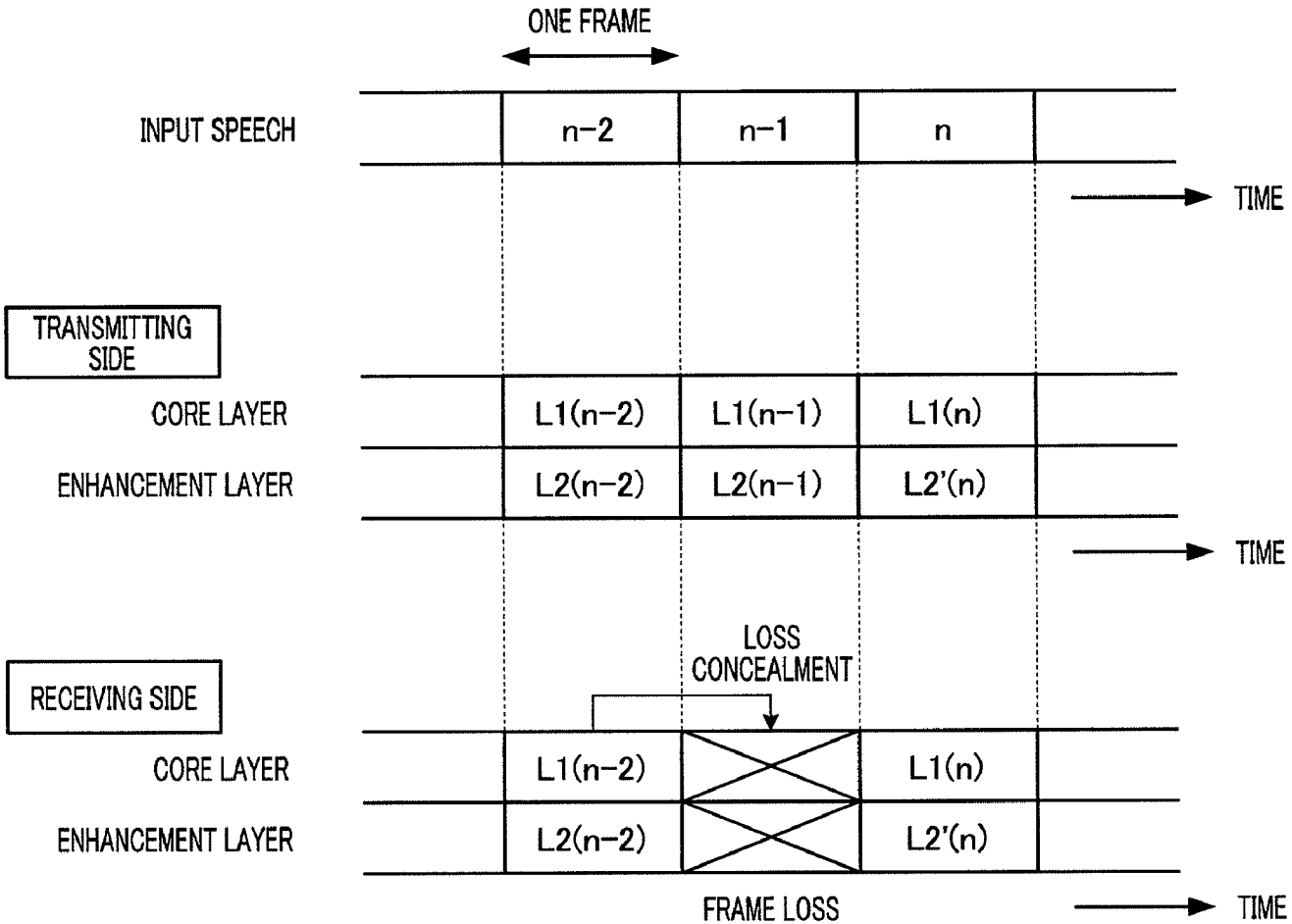
FIG. 3 illustrates processing upon frame loss according to Embodiment 1.

Next, FIG. 3 shows processing upon frame loss. Now, assume that, on the transmitting side (scalable coding apparatus 10), enhancement layer deterioration correction coded data L2'(n) is selected upon coding of the enhancement layer of the n-th frame, and, on the receiving side (on the scalable decoding apparatus side), frame loss occurs in the (n−1)-th frame and loss in the (n−1)-th frame is concealed for using the (n−2)-th frame. In the n-th frame on the receiving side, it is possible to improve quality deterioration of decoded speech of L1(n) encoded without assuming frame loss in the (n−1)-th frame using L2'(n) encoded assuming frame loss in the (n−1)-th frame.

Figure 4:
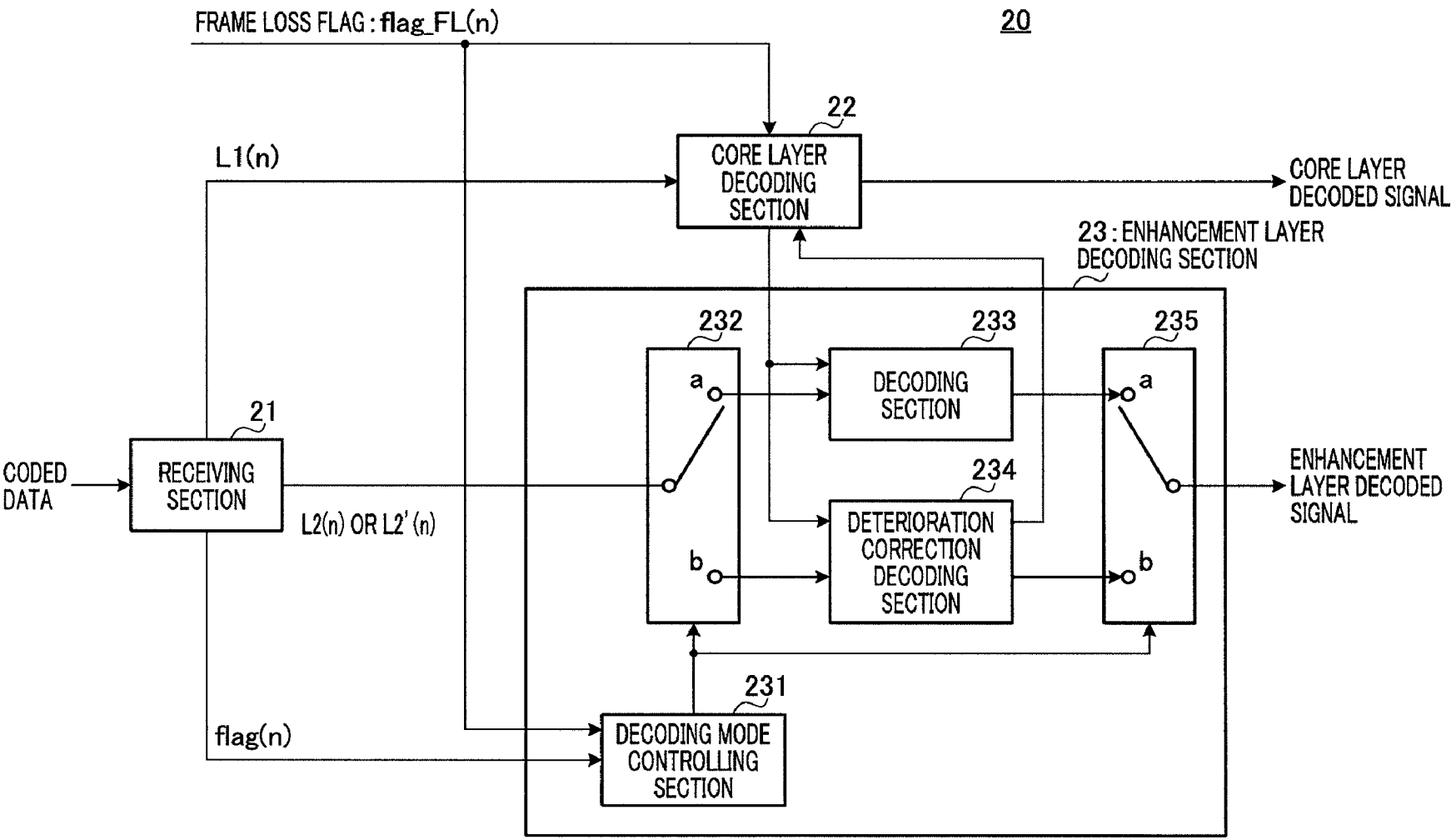
FIG. 4 is a block diagram showing a configuration of a scalable decoding apparatus according to Embodiment 1.

FIG. 4 is a block diagram showing a configuration of scalable decoding apparatus 20 according to Embodiment 1 of the present invention. Similar to scalable coding apparatus 10, scalable decoding apparatus 20 employs a configuration comprised of two layers of the core layer and the enhancement layer. A case will be described below where scalable decoding apparatus 20 receives coded data of the n-th frame from scalable coding apparatus 10 and carries out decoding processing.

Receiving section 21 receives coded data where core layer coded data L1(n), enhancement layer coded data (enhancement layer general coded data L2(n) or enhancement layer deterioration correction coded data L2'(n)) and a decision result flag, flag(n) are multiplexed, from scalable coding apparatus 10, and outputs core layer coded data L1(n) to core layer decoding section 22, enhancement layer coded data to switching section 232 and the decision result flag, flag(n), to decoding mode controlling section 231.

Further, core layer decoding section 22 and decoding mode controlling section 231 of enhancement layer decoding section 23 receive inputs of frame loss flags, flag_FL(n), showing whether or not frame loss occurs in the n-th frame, from frame loss detecting section (not shown).

Decoding processing carried out according to content of the decision result flag and the frame loss flag will be described using FIG. 5. Further, with the frame loss flag (flag_FL(n−1), flag_FL(n)), "0" shows that there is no frame loss and "1" shows that there is frame loss.

<Condition 1: where flag_FL(n−1)=0, flag_FL(n) =0 and flag(n)=0>

Core layer decoding section 22 carries out decoding processing using core layer coded data L1(n) inputted from receiving section 21 and generates a core layer decoded signal of the n-th frame. This core layer decoded signal is also inputted to decoding section 233 of enhancement layer decoding section 23. Further, in enhancement layer decoding section 23, decoding mode controlling section 231 switches switching sections 232 and 235 to the "a" side. Consequently, decoding section 233 carries out decoding processing using enhancement layer general coded data L2(n) and outputs an enhancement layer decoded signal as results of decoding both in the core layer and the enhancement layer.

<Condition 2: where flag_FL(n−1)=0, flag_FL(n) =0 and flag(n)=1>

Core layer decoding section 22 carries out decoding processing using core layer coded data L1(n) inputted from receiving section 21 and generates a core layer decoded signal of the n-th frame. This core layer decoded signal is also inputted to decoding section 233 of enhancement layer decoding section 23. Further, in enhancement layer decoding section 23, decoding mode controlling section 231 switches switching sections 232 and 235 to the "a" side. flag(n)=1, and enhancement layer general coded data L2(n) is not received, and so decoding section 233 carries out concealment processing for the n-th frame of the enhancement layer using enhancement layer general coded data up to the (n−1)-th frame, an enhancement layer decoded signal decoded using this enhancement layer general coded data and a core layer decoded signal of the n-th frame (or, for example, decoding parameters used for decoding), generates an enhancement layer decoded signal of the n-th frame and outputs this signal.

<Condition 3: where flag_FL(n)=1>

No coded data of the n-th frame is received, and so core layer decoding section 22 carries out concealment processing for the n-th frame of the core layer using, for example, core layer coded data up to the (n−1)-th frame, a core layer decoded signal decoded using the core layer coded data and decoding parameters used for decoding, and generates a core layer decoded signal of the n-th frame. Further, in enhancement layer decoding section 23, decoding mode controlling section 231 switches switching sections 232 and 235 to the "a" side. Decoding section 233 carries out concealment processing for the n-th frame of the enhancement layer using, for example, enhancement layer general coded data up to the (n−1)-th frame, a decoded signal decoded using this enhancement layer general coded data and a core layer decoded signal of the n-th frame (or decoding parameters used for decoding), generates an enhancement layer decoded signal of the n-th frame and outputs this signal.

<Condition 4: where flag_FL(n−1)=1, flag_FL(n) =0 and flag(n)=0>

Frame loss occurs in the (n−1)-th frame, which is different from condition 1. However, decoding processing is the same as the case of condition 1.

<Condition 5: where flag_FL(n−1)=1, flag_FL(n) =0 and flag(n)=1>

Core layer decoding section 22 carries out decoding processing using core layer coded data L1(n) inputted from receiving section 21 and generates a core layer decoded signal of the n-th frame. This core layer decoded signal is inputted to deterioration correction decoding section 234 of enhancement layer decoding section 23. Further, in enhancement layer decoding section 23, decoding mode controlling section 231 switches switching sections 232 and 235 to the "b" side. Frame loss occurs in the (n−1)-th frame, loss is concealed for and enhancement layer deterioration correction coded data L2'(n) generated by coding assuming this frame loss concealment (coding for correcting deterioration) is received, and so deterioration correction decoding section 234 carries out decoding processing using enhancement layer deterioration correction coded data L2'(n) and outputs the enhancement layer decoded signal as a result of decoding both the core layer and the enhancement layer. Further, state data is updated in the process of this decoding processing, and, accompanying this updating, state data stored in core layer decoding section 22 is updated in the same way.

Here, processing in the n-th frame on the receiving side (on the scalable decoding apparatus side) shown in above FIG. 3 is decoding processing in the case of above condition 5. That is, when loss occurs in the (n−1)-th frame, by concealing for loss in the (n−1) frame using the (n−2)-th frame and carrying out decoding processing in the n-th frame using L2'(n) encoded assuming loss in the (n−1)-th frame, scalable decoding apparatus 20 is able to improve quality deterioration of decoded speech resulting from L1(n) encoded without assuming loss in the (n−1)-th frame.

In this way, according to this embodiment, when encoding the enhancement layer with respect to the n-th frame, a scalable coding apparatus carries out coding assuming loss concealment with respect to frame loss in the (n−1)-th frame, so that, when loss occurs in the (n−1)-th frame and loss is concealed for, a scalable decoding apparatus is able to improve quality deterioration of decoded speech in the n-th frame.

Embodiment 2

Figure 6:
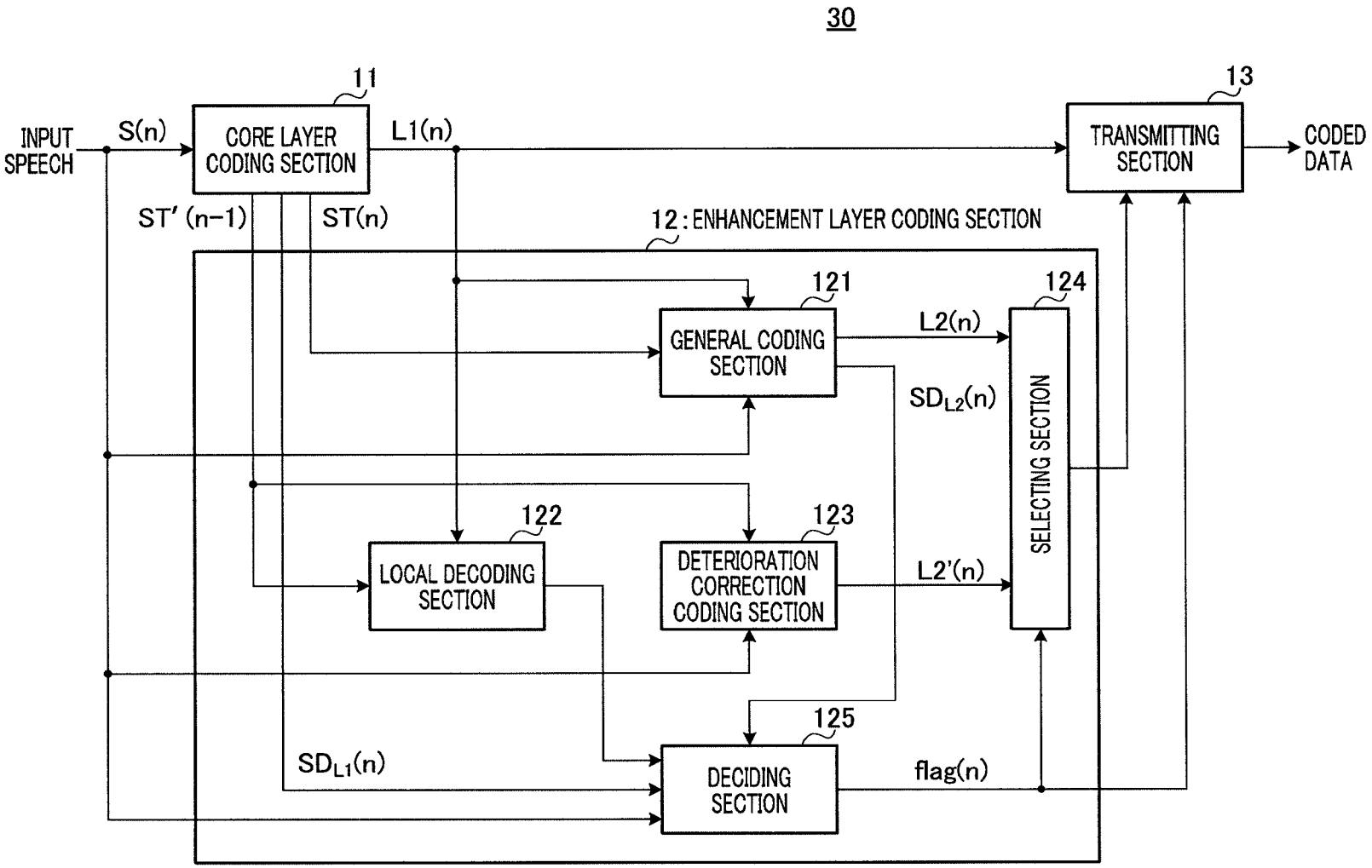
FIG. 6 is a block diagram showing a configuration of a scalable coding apparatus according to Embodiment 2.

FIG. 6 is a block diagram showing a configuration of scalable coding apparatus 30 according to Embodiment 2 of the present invention. FIG. 6 differs from Embodiment 1 (FIG. 1) in inputting state data ST'(n−1) of the (n−1)-th frame to deterioration correction coding section 123 instead of core layer coded data L1(n) and not inputting output from local decoding section 122, to deterioration correction coding section 123.

Assuming that frame loss concealment for the (n−1)-th frame is carried out, deterioration correction coding section 123 shown in FIG. 6 encodes input speech signal S(n) of the n-th frame using state data ST'(n−1) assuming frame loss concealment for the (n−1)-th frame, and generates enhancement layer deterioration correction coded data L2'(n). That is, deterioration correction coding section 123 according to this embodiment encodes input speech signals separately from the core layer instead of encoding the enhancement layer assuming coding of the core layer.

On the other hand, the configuration of the scalable decoding apparatus according to this embodiment is the same as Embodiment 1 (FIG. 4), but differs from Embodiment 1 in decoding processing of above condition 5. That is, in a case matching with above condition 5, deterioration correction decoding section 234 differs from Embodiment 1 in carrying out decoding processing using enhancement layer deterioration correction coded data L2'(n) without depending on core layer decoded data.

Further, in this embodiment, deterioration correction coding section 123 may encode input speech signals using state data which is all reset. By this means, the scalable decoding apparatus is able to keep consistency with the coding in the scalable coding apparatus without the influence of the number of consecutive frame losses and generate decoded speech using enhancement layer deterioration correction coded data.

In this way, according to this embodiment, deterioration correction coding section 123 encodes input speech signals separately from the core layer instead of encoding the enhancement layer assuming coding of the core layer, so that, when a core layer decoded signal of the n-th frame deteriorates significantly due to loss concealment for the (n−1)-th frame, the scalable decoding apparatus is able to improve decoded speech quality using enhancement layer deterioration correction coded data without the influence of this deterioration.

Embodiments of the present invention have been described.

Further, although cases have been described with the above embodiments as examples where a scalable configuration is formed with two layers, the present invention can be realized in the same way to a scalable configuration of three or more layers.

Further, although configurations have been described with the above embodiments assuming cases where frame loss occurs one at a time, a configuration assuming cases where frame losses continue can be employed. That is, a configuration may be employed where deterioration correction coding section 123 carries out coding assuming that frame loss concealment continues in m frames (where m=1, 2, 3, . . . and N) including the (n−1)-th frame and collectively outputs a set of N items of enhancement layer deterioration correction coded data L2'_m (n) associated with frame loss which continues m times, to the desired number of frames. Further, deterioration correction decoding section 234 may carry out decoding using enhancement layer deterioration correction coded data L2'_k(n) matching with the number of frame losses k which actually continued.

Further, to support cases where frames losses have continued, using the configurations of the above embodiments assuming cases where frame loss occurs one at a time, the scalable decoding apparatus may generate an enhancement layer decoded speech signal by carrying out frame loss concealment processing for the enhancement layer without using enhancement layer deterioration correction coded data L2'(n).

Further, the configuration of deterioration correction coding section 123 may combine Embodiment 1 and Embodiment 2. That is, deterioration correction coding section 123 may carry out coding in both Embodiments 1 and 2, select enhancement layer deterioration correction coded data L2'(n) that makes coding distortion smaller and output this data with selection information. By this means, it is possible to further improve quality deterioration of decoded speech in a next normal frame after a frame where frame loss has occurred.

Further, when the present invention is applied to a network (for example, IP network) where a packet formed with one frame or a plurality of frames as transmission units, a "frame" in the above embodiments may be read as a "packet."

The scalable coding apparatus and scalable decoding apparatus according to the above embodiments can also be mounted on wireless communication apparatuses such as wireless communication mobile station apparatuses and wireless communication base station apparatuses used in mobile communication systems.

Also, although cases have been described with the above embodiments as examples where the present invention is configured by hardware, the present invention can also be realized by software. For example, it is possible to implement the same functions as in the scalable coding apparatus and scalable decoding apparatus according to the present invention by describing algorithms of the scalable coding method and scalable decoding method according to the present invention using the programming language, and executing this program with an information processing section by storing in memory.

Each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The present application is based on Japanese Patent Application No. 2005-346169, filed on Nov. 30, 2005, the entire content of which is expressly incorporated by reference herein.

INDUSTRIAL APPLICABILITY

The scalable coding apparatus, scalable decoding apparatus, scalable coding method and scalable decoding method according to the present invention can be applied for use in, for example, speech coding.

The invention claimed is:

1. A scalable coding apparatus comprised of a lower layer and a higher layer, the apparatus comprising:

a lower layer coding section that encodes the lower layer and generates lower layer coded data;

a loss concealing section that carries out predetermined loss concealment for frame loss of the lower layer coded data and generates state data;

a first higher layer coding section where encoding in the higher layer is performed and first higher layer coded data is generated;

a second higher layer coding section that where encoding for correcting speech quality deterioration using the state data in the higher layer is performed and second higher layer coded data is generated; and a selecting section that selects one of the first higher layer coded data and the second higher layer coded data as transmission data.

2. The scalable coding apparatus according to claim 1, wherein, when a degree of deterioration of speech quality of the lower layer caused by the loss concealment is greater than a predetermined value, the selecting section selects the second higher layer coded data.

3. The scalable coding apparatus according to claim 1, wherein, when a degree of speech quality improvement resulting from coding of the higher layer is less than a predetermined value, the selecting section selects the second higher layer coded data.

4. The scalable coding apparatus according to claim 1, wherein, among higher layer coded data generated further using decoded data of the lower layer coded data and higher layer coded data generated without using decoded data of the lower layer coded data, the second higher layer coding section makes higher layer coded data that makes coding distortion smaller the second higher layer coded data.

5. A wireless communication mobile station apparatus comprising the scalable coding apparatus according to claim 1.

6. A wireless communication base station apparatus comprising the scalable coding apparatus according to claim 1.

7. A scalable coding method used in a scalable coding apparatus comprised of a lower layer and a higher layer, the method comprising:

Performing encoding in the lower layer and generating lower layer coded data;

carrying out predetermined loss concealment for frame loss of the lower layer coded data and generating state data;

performing encoding in the higher layer and generating first higher layer code data;

performing encoding in the higher layer for correcting speech quality deterioration using the state data and generating second higher layer coded data; and selecting one of the first higher layer coded data and the second higher layer coded data as transmission data.

* * * * *